United States Patent [19]

Silvestri et al.

[11] Patent Number: 4,708,780

[45] Date of Patent: Nov. 24, 1987

[54] PROCESS FOR THE ELECTROCARBOXYLATION OF CARBONYL COMPOUNDS, FOR PRODUCING α-HYDROXYCARBOXYLIC ACIDS

[75] Inventors: Giuseppe Silvestri; Salvatore Gambino; Giuseppe Filardo, all of Palermo, Italy

[73] Assignee: Consiglio Nazionale Delle Ricerche, Rome, Italy

[21] Appl. No.: 819,295

[22] Filed: Jan. 15, 1986

[30] Foreign Application Priority Data

Jan. 21, 1985 [IT] Italy ..... 19168 A/85

[51] Int. Cl.[4] ..... C25B 3/00; C25B 3/10

[52] U.S. Cl. ..... 204/59 R; 204/72; 204/75; 204/76; 204/77

[58] Field of Search ..... 204/59 R, 72, 75, 76, 204/77

[56] References Cited

U.S. PATENT DOCUMENTS

| | | | |
|---|---|---|---|
| 4,072,583 | 2/1978 | Hallcher et al. | 204/59 R |
| 4,582,577 | 4/1986 | Wagenknecht | 204/59 R |
| 4,601,797 | 7/1980 | Wagenknecht | 204/59 R |

OTHER PUBLICATIONS

Silvestri et al., Chem. Abst. 102(1955) #35188.

Ikeda et al., Chem. Letters 1984, pp. 453–454.

Engels et al., Angew Chem. Int. Ed. Eng. 22(1983); No. 6, pp. 492–493.

Harrison et al., Compendium of Organic Synthetic Methods Interscience, New York, N.Y., 1974, pp. 56–63.

*Primary Examiner*—Arthur P. Demers

*Attorney, Agent, or Firm*—Stevens, Davis, Miller & Mosher

[57] ABSTRACT

A process for the electrocarboxylation of carbonyl compounds, for producing α-hydroxycarboxylic acids by means of the reaction:

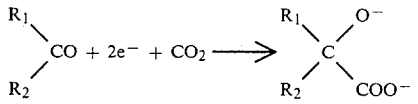

The electrolysis of the carbonyl compound is conducted in a diaphragm-less cell with a soluble metal anode in the presence of a support electrolyte and an organic solvent into which carbon dioxide is bubbled.

The complex salt obtained by the electrolysis is precipitated by treatment with a solvent, and is then separated and hydrolyzed to obtain the required acid.

9 Claims, No Drawings

PROCESS FOR THE ELECTROCARBOXYLATION OF CARBONYL COMPOUNDS, FOR PRODUCING α-HYDROXYCARBOXYLIC ACIDS

This invention relates to an electrocarboxylation process for producing carboxylic acids by inserting one or more carbon dioxide molecules into suitable substrates. More particularly, the invention relates to a process for the electrocarboxylation of carbonyl compounds, for producing α-hydroxycarboxylic acids.

The substrates used for the electrocarboxylation can be unsaturated compounds containing double olefinic bonds, compounds containing imino or carbonyl groups, polynuclear aromatic compounds, or organic halides, however the reaction of major interest is the electrocarboxylation of carbonyl compounds (reaction 1) as it enables α-hydroxycarboxylic acids to be prepared, these finding important application as intermediates in numerous organic syntheses:

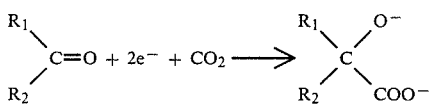

(1)

A very small number of examples are known relating to the electrocarboxylation of carbonyl compounds, and these are summarised in table 1:

TABLE 1

| | Electrocarboxylation of ketones (literature data) | | | | | | |
|---|---|---|---|---|---|---|---|
| | | | | | | yield | |
| Ref. | substrate | cathode | anode | solvent | diaphragm | product | current |
| (1) | benzo-phenone | Hg | Pt | DMF | YES | 48 | |
| (2) | aceto-phenone | Pb | Pt | Aceton. | NO* | 40 | 58 |
| (1) | aceto-phenone | Hg | Pt | DMF | YES | 4 | |
| (3) | p-ibut-acetophenone | Hg | Pt | DMF | YES | 85 | |

*The support electrolyte used is a tetraalkylammonium oxalate, which oxidises preferentially at the anode.
(1) S. Wawzonek, A. Gundersen, J. Electrochem. Soc. 107 (6), 537 (1960)
(2) R. Engels, C. J. Smit, W. J. M. Van Tilborg, Agnew, Chem. Int. Ed. Engl. 22 (6), 492 (1983)
(3) Y. Ikeda, E. Manda, Chem. Lett. 1984, 453.

With regard to aldehyde carboxylation, an attempt at benzaldehyde carboxylation is cited, but the authors (S. Wawzanek, A. Gundersen, J. Electrochem. Soc. 107 (6), 537, 1960) explicitly state that they obtain no trace of the expected carboxylation product, namely mandelic acid.

Compared with known processes, the process according to the present invention enables the range of substrates which can be carboxylated to be considerably widened, to the extent of making the reaction also possible on both aliphatic and aromatic aldehydes. It enables higher yields to be obtained, and finally enables a product recovery method to be applied which makes it possible to recycle the solvent-support electrolyte system. This latter aspect is of particular interest in its application to continuous processes.

The electrocarboxylation process for producing α-hydroxycarboxylic acids by inserting a carbon dioxide molecule into carbonyl compounds, according to the present invention, is characterized by using, for the electrolysis of the carbonyl compound, soluble metal anodes in diaphragm-less cells in which the electrolysis is effected in the presence of a support electrolyte and an organic solvent through which $CO_2$ is bubbled, and in that the product is recovered by adding to the solution originating from the electrolysis a solvent which precipitates the complex salt obtained by the electrolysis, this being separated and hydrolysed to obtain the required acid.

These and further characteristics and advantages of the process according to the present invention will be more apparent from the detailed description given hereinafter, which describes preferred embodiments of the invention, and is given for illustrative purposes only.

The electrolysis process according to the present invention uses soluble metal anodes, which enable diaphragm-less electrolytic cells to be used. The anode materials used include aluminium, zinc, magnesium, copper and, more generally, metals which within the reaction environment have an anodic dissolution voltage which is less than that of the other species present in solution.

The aforesaid metals can be used either singularly in the pure state or alloyed with each other or with other non-contaminating elements. Al, Zn and Mg are preferably used. Zinc gives a deposition of the metal in dendritic form at the cathode as a secondary process, with consequent lowering of the current yield. Magnesium gives rise to electropassivation phenomena after passage of small quantities of current.

The best results are obtained with aluminium anodes. It has been found possible to use industrial aluminium, of 99.0% purity.

The cathode can be graphite or the same material as the constituent material of the anode. Any high quality conductor can however be used.

The anodic metal dissolution reaction is followed, in solution, by reaction between the metallic cations $M^{n+}$ and the anions of the α-hydrocarboxylic acids. The processes which take place in the various sectors of the cell are as follows:

(at the anode)

$$2M \longrightarrow 2M^{n+} + 2ne^-$$

(at the cathode)

$$nR_1R_2CO + nCO_2 + 2ne^- \longrightarrow nR_1R_2\overset{O^-}{\overset{|}{C}}-CO_2^-$$

(in solution)

$$2M^{n+} + nR_1R_2\overset{O^-}{\overset{|}{C}}-CO_2^- \longrightarrow M_2(R_1R_2COCO_2)_n$$

The formation of the complex salts offers the immediate advantage of protection of the cathodic reaction product against any subsequent undesirable reactions. There is also inhibition of the basicity of the alkoxy anion, and consequent prevention of possible aldol or Cannizzaro condensation reactions, which could take place over a large part of the substrates to be carboxylated. Without pretending to give a theoretical explanation of the results, it seems probable that electrocarboxylation of benzaldehyde, which has not been attained with known processes, is made possible precisely by the formation of these complexes which, by inhibiting the basicity of the anion deriving from the reduction of the substrate, prevent the Cannizzaro reaction on the benzaldehyde itself.

Suitable support electrolytes are alkaline or alkaline-earth halides, ammonium halides, or alkyl-, cycloalkyl- or aryl-ammonium halides. Perchlorates, paratoluenesulphonates, hexafluorophosphates or tetrafluoroborates of the aforesaid cations can also be used.

The choice of the support electrolyte is in any event made such as to prevent precipitation of insoluble salts between the metallic cation originating from the anode and the electrolyte anion.

The solvent preferably used is N,N-dimethylformamide. It is however also possible to use other liquid amides, nitriles, open or cyclic chain ethers, etc.

The electrolysis is generally conducted by keeping the cathodic potential constant relative to a suitable reference electrode.

Suitable reference electrodes are a calomel electrode, or an electrode comprising silver/silver iodide in a solution of iodide ions of known concentration in the same solvent as that used for the synthesis. The value at which the cathodic potential is fixed depends on the substrates subjected to the reaction, and is determined by normal electroanalytical techniques.

For very volatile substrates such as acetic aldehyde, electrolysis under moderate carbon dioxide pressures must be used in order to prevent the bubbling gas entraining the substrate from the electrolytic solution.

Two methods can be used for recovering the required $\alpha$-hydroxycarboxylic acids from the solution originating from the electrolysis.

The first method, which falls within the known art, comprises evaporating the solvent, acid hydrolysis of the residual complex salt, followed by extraction of the acid product from the acid hydrolysis liquor. This method, which is fairly simple, results however in the loss of the support electrolyte, which is discharged into the mother liquor of the final extraction.

The second method, which together with the electrolysis constitutes a subject of the invention, comprises the following stages:

- adding solvents to the electrolytic solution to precipitate the complex salt obtained;
- filtering to separate the complex salt;
- hydrolysing the complex salt and recovering the acid obtained;
- removing the precipitating solvent from the filtrate by evaporation under vacuum or by simple heating, and recovering the electrolytic solution (solvent and support electrolyte). The recovered electrolytic solution can be again used for a subsequent electrolysis. The precipitating solvent used is preferably diethyl ether, but other volatile solvents such as higher ethers can also be used.

The process of the invention has considerable advantages over the processes of the known art.

Firstly, the use of soluble anodes avoids the many serious problems related to the use of ion exchange membranes for separating the anolyte from the catholyte, such as the high ohmic resistance introduced by the membrane, the high cell manufacturing costs, and the easy perishability of the membranes.

With regard to electrolysis in diaphragm-less cells, the process of ref. 2 of Table 1 is already known. However, this process uses a special anodic reaction, namely the anodic oxidation of oxalates, which have a less positive oxidation potential than in the case of decarboxylation of higher carboxylic acids.

In this case, the comparison is made by considering both the cost of the two anodic processes and the effects of the species in solution on the synthesis itself.

In comparing the costs of the two anodic processes, it need only be noted that assuming a ketone of MW 200 is to be electrocarboxylated, and both processes have a 90% yield, the material consumptions of the anodic reaction are respectively 450 g of anion oxalate and 90 g of aluminium per kg of acid produced.

Assuming that aluminium and oxalic acid are approximately of equal price, the soluble anode process, if using aluminium, costs about five times less than the oxalate process for the anodic reaction.

It should also be noted that the use of oxalates offers no protection to the species formed in solution, and in particular does not inhibit the basicity of the intermediate species. Electrocarboxylation of reactive species such as the said benzaldehyde therefore becomes impossible or very difficult.

With regard to product recovery, the known methods used in the processes of Table 1 are as follows:

- solvent evaporation followed by acid hydrolysis of the residue and extraction of the acid produced, with consequent loss of the support electrolyte;
- addition of methyl iodide to the electrolytic solution and fractional distillation of the ester produced, with loss of the support electrolyte. The ester is subsequently hydrolysed and the acid recovered;
- solvent evaporation followed by precipitation with water and filtration of the support electrolyte ($Bu_4NI$), acid hydrolysis of the residual solution and recovery of the acid produced by ether extraction of the oily crude product formed.

Of these methods, only the third allows efficient recovery of the support electrolyte and solvent, but the precipitation with water implies a further drying stage before re-use of the support electrolyte. It should be noted that all three separation methods require distillation of the solvent from the solution originating from the cell.

In contrast, with the process according to the invention, it is possible, as stated, to recover the complex salts by simple filtration, with total recycling of the electrolytic solution.

The following examples are given for non-limiting illustrative purposes.

EXAMPLE 1

A solution formed from 2.5 g of tetrabutylammonium bromide and 2.0 g of benzophenone in 50 ml of N,N-dimethylformamide is electrolysed in a glass cell containing, in alternate positions, two aluminium electrodes with a total facing surface of 30 $cm^2$ and three zinc electrodes with a total facing surface of 40 $cm^2$, all with parallel flat faces, at a distance of 5 mm apart.

The zinc electrodes function as the cathode and the aluminium electrodes function as the anode. Suitable bubblers are arranged in the spaces between the electrodes. A reference electrode (Ag/AgI in N,N-dimethylformamide 0.1M $Bu_4NI$) is placed a short distance from one of the cathode faces. The cell is placed in a temperature-controlled bath adjusted to 20° C.

Before electrolysis, the solution is deaerated by bubbling $CO_2$ through for about 30 minutes. Current is then fed to the cell by way of a potentiostat, fixing the cathodic potential at −1.7 V relative to the said reference electrode. The intensity of the current circulating through the cell is about 500 mA. During the entire electrolysis, the solution is kept at 20° C. and $CO_2$ is bubbled through at a rate of 30/120 Nl/h.

After passing 2800 Coulombs, the electrical supply is interrupted, the cell is emptied and the electrolytic solution is evaporated at a pressure of 30 mmHg.

The residue is treated with an aqueous 10% HCl solution, and the resultant suspension extracted with ether.

The ether is evaporated to obtain a residue weighing 2.16 g. The residue is analysed by NMR spectroscopy, elementary analysis and acid-base titration, and is found to consist of crude diphenylhydroxyacetic acid of 87% purity.

The yield with respect to the benzophenone is 75%, and the current yield is 57%.

EXAMPLE 2

The solution to be electrolysed contains 5 g of 6-methoxyacetonaphthone and 2.5 g of tetrabutylammonium bromide dissolved in 50 ml of N,N-dimethylformamide.

The electrolysis procedure and the cell and electrode type are identical to those described in Example 1. 5000 Coulombs are passed, and the solution is then transferred from the cell into a glass flask fitted with an agitator, to which 200 ml of diethyl ether are added under agitation.

A white-yellow solid precipitates, and is filtered through a G3 filter.

The solid is dried under reduced pressure (30 mmHg at 40° C. for 1 hour) and is then treated with an aqueous 10% HCl solution. The suspension obtained is extracted with ether.

Evaporation of the ether produces a straw-coloured solid of weight 5.43 g, which by elementary analysis, NMR spectroscopy and acid-base titration is identified as crude 2-hydroxy-2-(6-methoxy-2-naphthyl)propionic acid (93% purity). The yields are 85% with respect to the ketone and 82% for current.

The mother liquor resulting from the filtration, and consisting of tetrabutylammonium bromide, N,N-dimethylformamide and a small quantity of the initial ketone (about 3%), together with the ether added to induce the precipitation, is evaporated under reduced pressure to remove the ether and regenerate the electrolytic solution for use in a subsequent electrolysis.

EXAMPLES 3 TO 11

The substrates used, the operating conditions and the yields obtained in these examples are summarised in Table 2.

With the exceptions contained in the note to Table 2, the procedure used employed N,N-dimethylformamide as solvent, 0.1M tetrabutylammonium bromide as support electrode, an aluminium anode, a cathodic surface of 40 $cm^2$, a current density of 15–25 $mA/cm^{-2}$, an Ag/AgI 0.1M in DMF reference electrode, a temperature of 20° C., and a $CO_2$ pressure of 1 atmosphere.

TABLE 2

| Examples 3 to 10 | | | | | |
|---|---|---|---|---|---|
| Example No. | Substrate | $V_{cath./ref.}$ | Recovery method | Product yield | Current yield |
| 3 | acetopheone | 1.5 | (B) | 62 | 55 |
| 4 | benzophenone (**) | 1.1 | (A) | 75 | 57 |
| 5 | 2-acetonaphthone | 1.35 | (B) | 81 | 57 |
| 6 | 2-acetonaphthone (*) | 1.4 | (A) | 58 | 41 |
| 7 | 6-methoxy-2-acetonaphtone | 1.4 | (B) | 90 | 83 |
| 8 | 6-methoxy-2-acetonaphthone (**) | 1.5 | (A) | 47 | 33 |
| 9 | acetaldehyde | (***) | (A) | 9 | 8 |
| 10 | benzaldehyde | 1.2 | (B) | 24 | 20 |
| 11 | p. isobutylacetophenone | 1.3 | (A) | 87 | 70 |

(*) Zinc anode/compact graphite cathode.
(**) Zinc anode.
(***) Test carried out under amperostatic conditions in an electrochemical reactor under pressure, p $CO_2$ = 5 atm; significant quantities of oxalic acid were obtained.
(A) Recovery effected by the method of Example 1.
(B) Recovery effected by the method of Example 2.

We claim:

1. An electrocarboxylation process for producing α-hydroxycarboxylic acids by inserting a carbon dioxide molecule into carbonyl compounds, characterized by using soluble metal anodes selected from the group consisting of aluminum, zinc, magnesium, copper and their alloys for electrolysis, conducting the electrolysis of the carbonyl compound in diaphragm-less cells in the presence of a support electrolyte and an organic solvent into which carbon dioxide is bubbled, recovering a product by adding to the solution subjected to electrolysis a solvent which causes precipitation of the complex salt obtained by the electrolysis, and separating and hydrolyzing the product to obtain the required acid.

2. A process as claimed in claim 1, characterized in that said support electrolyte comprises a compound selected from the group consisting of alkali metal halide alkaline-earth halide, ammonium halide, alkylammonium halide, cycloalkylammonium halide and arylammonium halide.

3. A process as claimed in claim 1, characterized in that said organic solvent is a solvent selected from the group consisting of N,N-dimethylformamide, and other liquid amides, a nitrile, and an open or cyclic chain ether.

4. A process as claimed in claim 1, characterised in that the electrolysis of the carbonyl compound is conducted at a temperature of between 0° and 50° C.

5. A process as claimd in claim 1, characterised in that the electrolysis of the carbonyl compound is conducted at a carbon dioxide pressure of between 1 and 20 atmospheres.

6. A process as claimed in claim 1, characterized in that said solvent for precipitating the complex salt obtained by the electrolysis is selected from the group consisting of diethyl ether and higher ethers.

7. A process as claimed in claim 1, characterised in that said separation of the complex salt obtained by the electrolysis is effected by filtration.

8. A process as claimed in claim 1, characterised in that said hydrolysis of the complex salt obtained by the electrolysis is effected by treatment with a 10% aqueous HCl solution.

9. A process as claimed in claim 1, characterised in that the liquid phase originating from the separation of the complex salt obtained by the electrolysis is evaporated to remove the solvent and recycled to the next electrolysis.

* * * * *